US006911649B2

(12) United States Patent
Hess et al.

(10) Patent No.: US 6,911,649 B2
(45) Date of Patent: Jun. 28, 2005

(54) PARTICLE GENERATOR

(75) Inventors: Wayne P. Hess, Richland, WA (US); Alan G. Joly, Richland, WA (US); Daniel P. Gerrity, Milwaukie, OR (US); Kenneth M. Beck, Kennewick, WA (US); Peter V. Sushko, Wembley (GB); Alexander L. Shlyuger, Kenton (GB)

(73) Assignees: Battelle Memorial Institute, Richland, WA (US); Reed College, Portland, OR (US); University College London, London (GB)

( * ) Notice: Subject to any disclaimer, the term of this patent is extended or adjusted under 35 U.S.C. 154(b) by 108 days.

(21) Appl. No.: 10/177,745

(22) Filed: Jun. 21, 2002

(65) Prior Publication Data

US 2003/0234354 A1 Dec. 25, 2003

(51) Int. Cl.[7] ..... H05H 3/00

(52) U.S. Cl. ..... 250/251; 250/423 R; 250/427; 315/111.21; 315/111.81; 437/225; 437/228; 156/345

(58) Field of Search ..... 250/251, 423 R, 250/427; 315/111.21, 111.81; 437/225, 228; 156/345

(56) References Cited

U.S. PATENT DOCUMENTS

| | | | |
|---|---|---|---|
| 4,091,256 A | | 5/1978 | Früchtenicht |
| 4,894,511 A | | 1/1990 | Caledonia et al. |
| 5,216,241 A | | 6/1993 | Hatakeyama et al. |
| 5,304,514 A | | 4/1994 | Nishibe et al. |
| 5,395,474 A | | 3/1995 | Suzuki et al. |
| 5,597,495 A | | 1/1997 | Keil et al. |
| 5,654,541 A | | 8/1997 | Outlaw et al. |
| 5,834,768 A | * | 11/1998 | Outlaw et al. |
| 5,883,005 A | | 3/1999 | Minton et al. |
| 5,916,822 A | | 6/1999 | Goldstein et al. |
| 6,245,648 B1 | | 6/2001 | Coleman |

FOREIGN PATENT DOCUMENTS

WO WO96/10324 4/1996

OTHER PUBLICATIONS

Hess et al., Selective Laser Desorption of Ionic Surfaces; Resonant Surface Excitation of KBr, Journal of Chemical Physics, 115,20,9463 (Nov. 22, 2001 ).*

Hess et al., " Solid–State Halogen Atom Source for Chemical Dynamics and Etching", Applied Physics Letters, 80,25 ( Jun. 24, 2002 ).*

J.C. McConnell et al., "Photochemical bromine production implicated in Artic boundary–layer ozone depletion," *Nature*, vol. 355, pp. 150–152 (1992).

J.F. Hopper et al., "Ozone and meteorology during the 1994 Polar Sunrise Experiment," *J. Geophys. Res.*, vol. 103, No. D1, pp. 1481–1492 (1998).

B.T. Jobson et al., "Measurement of $C_2$–$C_6$ hydrocarbons during the Polar Sunrise 1992 Experiment: Evidence for C1 atom and Br atom chemistry," *J. Geophys. Res.*, vol. 99, No. D12, pp. 25,355–25,368 (1994).

(Continued)

*Primary Examiner*—John R. Lee
*Assistant Examiner*—Zia R. Hashmi
(74) *Attorney, Agent, or Firm*—Klarquist Sparkman, LLP

(57) ABSTRACT

Energy tunable solid state sources of neutral particles are described. In a disclosed embodiment, a halogen particle source includes a solid halide sample, a photon source positioned to deliver photons to a surface of the halide, and a collimating means positioned to accept a spatially defined plume of hyperthermal halogen particles emitted from the sample surface.

38 Claims, 10 Drawing Sheets

OTHER PUBLICATIONS

C.C. Cheng et al., "Mechanism for anisotropic etching of photoresist–masked, polycrystalline silicon in HBr plasma," *J. Vac. Sci. Technol. B*, vol. 14, No. 1, pp. 85–90 (1996).

W.C. Simpson et al., "Fundamental Studies of Halogen Reactions with III–V Semiconductor Surfaces," *Annu. Ref. Phys. Chem.* vol. 47, pp. 527–554 (1996).

J. Brake et al., "Coverage–dependent etching pathways for Br–GaAs(110)," *J. Vac. Sci. Technol. B*, vol. 15, No. 3, pp. 670–674 (1997).

K.M. Beck et al., "Evidence for a surface exciton in KBr via laser desorption," *Phys. Rev. B.*, vol. 63, pp. 125423–1–125423–6 (2001).

V.E. Puchin et al., "Theoretical studies of atomic emission and defect formation by electronic excitation at the (100) surface of NaCl," *Phys. Rev. B.*, vol. 47, No. 16, pp. 10760–10768 (1993).

V.E. Puchin et al., "The excitonic mechanism of Na–atom desorption from the (100)NaC1 surface," *J. Phys. Condens. Matter*, vol. 7, pp. L147–L151 (1995).

W.P. Hess et al., "Selective laser desorption of ionic surfaces: Resonant surface excitation of KBr," *J. Chem. Phys.*, vol. 115, No. 20, pp. 9463–9472 (2001).

R.A. Bradley Jr. et al., "Molecular NO Desorption from Crystalline Sodium Nitrate by Resonant Excitation of the $NO_3^-$ $\pi\pi^*$ Transition,"*J. Phys. Chem.*, vol. 99, pp. 11715–11721 (1995).

K.M. Beck et al., "Photostimulated desorption of CO from geologic calcite following 193–nm irradiation," *Phys. Rev. B.*, vol. 55, No. 19, pp. 13253–13262 (1997).

S. Arepalli et al., "The Detection of Bromine Atoms by Resonant Multiphoton Ionization," *Chem. Phys. Lett.*, vol. 117, No. 1, pp. 64–66 (1985).

J.E. Eby et al., "Ultraviolet Absorption of Alkali Halides," *Phys. Rev.*, vol. 116, No. 5, pp. 1099–1105 (1959).

T. Tomiki et al., "The Urbach Rule for the Sodium– and Potassium–Halides,"*Z. Naturforsch*, vol. 29a, pp. 145–157 (1974).

K. Tanimura et al., Comments on "Role of Impurities on the Primary Process for F–Coloring in Alkali Halides," *Radiat. Eff. Lett.*, vol. 57, pp. 155–159 (1980).

Ch. Lushchik et al., "Mechanisms of Cation Defects Creation in Alkali Halides," *Semicond. and Insulat.*, vol. 5, pp. 133–152 (1980).

P.H. Bunton et al., "Observation of photon–stimulated desorption following valence–band excitation of alkali halides," *Phys. Rev. B.*, vol. 45, No. 9, pp. 4566–4571 (1992).

N. Zema et al., "Spectroscopic behavior of halogen photodesorption from alkali halides under UV and VUV excitation," *Phys. Rev. B.*, vol. 55, No. 8, pp. 5448–5454 (1997).

M. Szymoński et al., "Electron–Stimulated Desorption from Ionic Crystal Surfaces," *Prog. Surf. Sci.*, vol. 48, Nos. 1–4, pp. 83–96 (1995).

B. Such et al., "Surface Topography Dependent Desorption of Alkali Halides," *Phys. Rev. Lett.*, vol. 85, No. 12, pp. 2621–2624 (2000).

A. Alexandrov et al., "Role of Excitons in Electron– and Photon–Stimulated Desorption of Neutrals from Alkali Halides," *Phys. Rev. Lett.*, vol. 86, No. 3, pp. 536–539 (2001).

H. Guo et al., "Theory of photoinduced surface reactions of admolecules," *Prog. Surf. Sci*, vol. 62, pp. 239–303 (1999).

J.J. Kolodziej et al., "Hot–carrier transport processes in stimulated desorpton of alkali halides," *Phys. Rev. B*, vol. 58, No. 19, pp. 13204–13211 (1998).

C.R. Fu et al., "Decay of the self–trapped exciton near the (001) surface in NaBr and KBr," *J. Phys.: Condens. Matter*, vol. 11, pp. 5699–5708 (1999).

J.J. Kolodziej et al., "Frenkel defect interactions at surfaces of irradiated alkali–halides studied by non–contact atomic–force microscopy," *Surf. Sci.*, vols. 482–485, pp. 903–909 (2001).

K. Teegarden et al., "Optical Absorption Spectra of the Alkali Halides at 10°K," *Phys. Rev.*, vol. 155, No. 3, pp. 896–907 (1967).

A.L. Shluger et al., "Spectroscopy of low–coordinated surface sites: Theoretical study of MgO," *Phys. Rev. B*, vol. 59, No. 3 (1999).

G.P. Kota et al., "Heteronuclear and homonuclear surface abstraction reactions of C1, Br, and F," *J. Appl. Phys.*, vol. 85, No. 1, pp. 74–75 (1999).

P.M. Regan et al., "The ultraviolet photodissociation dynamics of hydrogen bromide," *J. Chem. Phys.*, vol. 110, No. 1, pp. 281–283 (1999).

Y. Jung et al., "Photodissociation of $CBrC1_3$ at 234 and 265 nm: Evidence of the curve crossing," *J. Chem. Phys.*, vol. 111, No. 9, pp. 4005–4006 (1999).

M.J. Cooper et al., "Ion imaging studies of the $Br(^2P_J)$ atomic products resulting from $Br_2$ photolysis in the wavelength range 260–580 nm," *J. Chem. Soc., Farraday Trans.*, vol. 94, pp. 2901–2907 (1998).

P. Zou et al., "Quantum yields and energy partitioning in the ultraviolet photodissociation of 1,2 dibromo–tetrafluoroethane (Halon–2402)," *J. Chem. Phys.*, vol. 113, No. 17, pp. 7149–7153 (2000).

J.A. Jensen et al., "Direct Chemisorption Site Selectively for Molecular Halogens on the Si(111)–(7×7) Surface," *Phys. Rev. Lett.*, vol. 76, No. 8, pp. 1388–1391 (1996).

P. Wurz et al., "Electron–stimulated desorption of neutral lithium atoms from LiF due to excitation of surface excitons," *Phys. Rev. B*, vol. 43, No. 8, pp. 6729–6732 (1991).

W.P. Hess et al., "Control of laser desorption tunable single pulses and pulse pairs," *J. Chem. Phys.*, vol. 116, No. 18, pp. 8144–8151 (2002).

W.P. Hess et al., "Solid–state halogen atom source for chemical dynamics and etching," *Appl. Phys. Lett.*, vol. 80, No. 25, pp. 1–3 (2002).

"Time of Flight Tutorial: The Ion Source," web site address www.rmjordan.com (2002).

M.C.R. Symons, "Hole centres in magnesium oxide," *Radiat. Phys. Chem.*, vol. 60, No. 1–2, pp. 39–41 (2001).

D.J. Tannor and S.A. Rice., "Coherent pulse control of product formation in chemical reactions," *Advances in Chemical Physics*, LXX, Part 1, pp. 441–523 (1988).

M. Szymonski, Mat. Fys. Medd. Dan. Vid. Selsk., vol. 43, pp. 495–526 (1993).

Proceedings of the Eighth International Workshop on Desorption Induced by Electronic Transitions, issued as Surface Sci. vol. 451, No. 1–3 (2000) edited by T.E. Madey, F.M. Zimmermann and A. Bartynski.

A.M. Stoneham, *Theory of Defects in Solids* (Clarendon, Oxford, 1975).

N. Itoh and A.M. Stoneham, *Materials Modification by Electronic Excitation* (Cambridge University Press, Cambridge, 2000).

C.B. Lushchik and A.C. Lushchik, *Decay of electronic excitations with defect formation in solids* (Nauka, Moscow, 1989).
K.S. Song and R.T. Williams, *Self–Trapped Excitons* (Springer–Verlag, Berlin, 1993).
A. Sinha et al., "Bond–selected bimolecular chemistry: H+HOD(4vOH)→OD+$H_2$," *J. Chem. Phys.*, vol. 92, No. 10, pp. 6333–6335 (1990).
A. Sinha et al., "Controlling bimolecular reactions: Mode and bond selected reaction of water with hydrogen atoms,"*J. Chem. Phys.*, vol. 94, No. 7, pp. 4928–4935 (1991).
R.B. Metz et al., "Selectively breaking either bond in the bimolecular reaction of HOD with hydrogen atoms," *J. Chem. Phys.*, vol. 99, No. 3, pp. 1744–1751 (1993).
R.J. Gordon et al., "Active Control of the Dynamics of Atoms and Molecules," *Annu. Rev. Phys. Chem.*, vol. 48, pp. 601–641 (1997).
R.J. Gordon et al., "Coherent Control of Chemical Reactions," *Acc. Chem. Res.*, vol. 32, pp. 1007–1016 (1999).
C.J. Bardeen et al., "Quantum Control of NaI Photodissociation Reaction Product States by Ultrafast Tailored Light Pulses," *J. Phys. Chem.*, vol. 101, pp. 3815–3822 (1997).
J.L. Herek et al., "Femtosecond control of an elementary unimolecular reaction from the transition–state region," *Chem. Phys. Lett.*, vol. 228, pp. 15–25 (1994).
E. Dupont et al., "Phase–Controlled Currents in Semiconductors," *Phys. Rev. Lett.*, vol. 74, No. 18, pp. 3596–3599 (1995).
A. Haché et al., "Observation of Coherently Controlled Photocurrent in Unbiased, Bulk GaAs," *Phys. Rev. Lett.*, vol. 78, No. 2, pp. 306–309 (1997).
A.L. Shluger et al., "Optical transitions of the H centers in alkali halides," *Phys. Rev. B*, vol. 52, No. 6, pp. 4017–4028 (1995).
A.L. Shluger et al., "Laser–induced reactions in crystals: Femtosecond pump–probe spectroscopy and *ab initio* calculations of self–trapped excitons and holes in KBr," *Phys. Rev. B*, vol. 61, No. 8, pp. 5392–5402 (2000).
A. Alexandrov et al., "Electron–stimulated desportion of iodine atoms from KI(100): an energy– and temperature–dependent study," *Surf. Sci.*, vol. 451, pp. 208–213 (2000).
J.T. Dickinson, "The role of defects in the laser ablation of wide bandgap materials," *Nucl. Instr. Meth. Phys. Res. B*, vol. 91, pp. 634–638 (1994).
C. Bandis et al., "Desorption of positiveions from ionic crystals accompanying 248 nm laser irradiation," *Appl. Phys. Lett.*, vol. 76, No. 4, pp. 421–423 (2000).
M. Szymonski et al., "Nano–scale modification of ionic surfaces induced by electronic transitions," *Prog. Surf. Sci.*, vol. 67, pp. 123–138 (2001).
V. Puchin et al., "Theoretical study of Na–atom emission from NaCl (100) surfaces," *Phys. Rev. B*, vol. 49, No. 16, pp. 11364–11373 (1994).
V.E. Puchin et al., "Model of self–trapped excitons in alkali halides," *Phys. Rev. B*, vol. 47, No. 11, pp. 6226–6240 (1993).
L.T. Hudson et al., "Electron– and photon–stimulated description of atomic hydrogen from radiation–modified alkali halide surfaces," *Phys. Rev. B*, vol. 62, No. 15, pp. 10535–10543 (2000).

* cited by examiner

PARTICLE GENERATOR

STATEMENT OF GOVERNMENT SUPPORT

This invention was made with United States Government support under Contract DE-AC06-76RLO-1830 awarded by the U.S. Department of Energy. The United States Government has certain rights in the invention.

FIELD

The invention relates to the generation of particle beams, and more particularly, to the generation of beams of halogen particles.

BACKGROUND

Reactive species, such as halogen species and halogen-containing compounds are used extensively in the microelectronics industry to dry etch silicon and other semiconductors. In dry etching, a substrate is exposed to reactive gases, ion beams or plasmas to remove material from the surface of the substrate. Halogen species and halogen-containing compounds are used as dry etchants because they react with many semiconductor materials to produce volatile products that are efficiently removed in a vacuum. Halogen species are often provided using plasma sources.

Unfortunately, dry etching often roughens the surface of a substrate, leading to defects, both physical and electronic, that affect performance of microelectronic devices. Roughening of a semiconductor surface during dry etching, especially during plasma etching, is understandable, as the multiple reactive species typically used react with the semiconductor surface at different rates. Even if a single reactive species were involved in such an etching process, a distribution of energies and trajectories can lead to differential etching rates across a substrate surface causing surface defects. Thus, many defects that arise during dry etching are a result of the inhomogeneity of the etchant itself. As microelectronic devices continue to shrink in size, even small defects that arise from the etching process become less tolerable, making well-characterized and controllable sources of reactive species desirable.

Emission of neutral halogen atoms from solid alkali halides may be stimulated using electron, ion and photon beams. Two types of emission are typically observed in these processes: emission of halogen atoms with a distribution of near-thermal energies and emission of halogen atoms having a distribution of hyperthermal energies. What has not been appreciated is that selective photo-excitation may provide control over the kinetic energy of hyperthermally emitted neutral halogen atoms and that hyperthermal emission from halide surfaces occurs with a narrow distribution of trajectories. These surprising discoveries, in part, make possible the presently disclosed solid state halogen sources.

SUMMARY

Solid state particle sources that provide reactant selectivity and control over reactant energy and trajectory are disclosed. The homogeneity of the particles produced by the disclosed sources provides increased control over etching processes and enables more careful study of reactions taking place between halogens and substrate surfaces. In one embodiment, a directed particle beam comprising hyperthermal neutral halogen atoms of controllable energy is generated by photo-excitation of a halide surface. For example, a halogen particle generator including a solid halide sample, a photon source positioned to deliver photons to the surface of the halide sample, and a collimating means positioned to accept a spatially defined plume of hyperthermal halogen atoms emitted from the surface of the halide sample is disclosed.

Methods of stimulating controllable particle emission from solid state sources are also included. For example, a method for producing a beam of halogen particles having a tunable kinetic energy is provided. In one embodiment, a flux of photons having an average energy between a bulk absorption threshold energy of a halide sample and a surface absorption threshold energy of the halide is provided. The flux of photons is directed to a surface of the halide sample to stimulate emission of hyperthermal halogen atoms. Because the average kinetic energy of the emitted hyperthermal halogen atoms is directly proportional to the average energy of the photons used, the average kinetic energy of the halogen particles may be adjusted by adjusting the energy of the incident photons.

DETAILED DESCRIPTION

Figure 1:
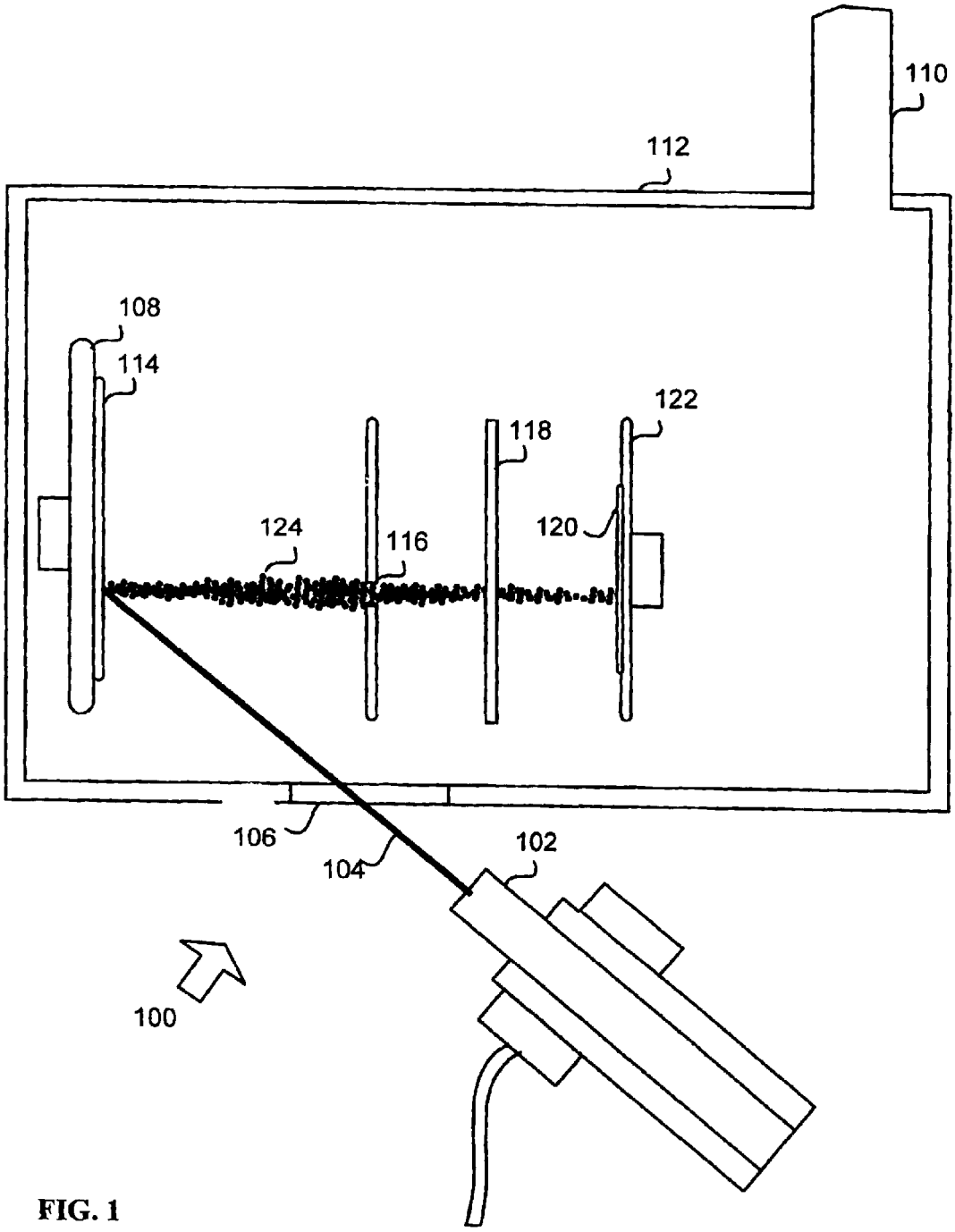
FIG. 1 illustrates an embodiment of an apparatus to generate halogen particles.

References to 'a', 'an', and 'one' embodiment do not necessarily refer to the same embodiment, although they may. In the figures, like numbers refer to like elements.

The halogen particle sources and the methods for producing halogen particles described herein are based, in part, on the discovery that the kinetic energy of neutral particles hyperthermally emitted from surfaces of insulators such as alkali halides and alkaline earth halides may be controlled by changing the energy of photons used to stimulate neutral particle emission. The disclosed sources and methods also are based, in part, on the discovery that photo-excited hyperthermal emission of particles from an insulator surface occurs in a spatially defined plume that may be used directly as a beam or further shaped and directed to provide a directed beam of neutral particles. In combination, such discoveries enable an energy-tunable and directed source of neutral particles. Additional control over the ratio of ground state to excited state particles in the sources may be obtained using pairs of photon pulses.

Unlike charged particles that can be easily accelerated and directed using electric fields, neutral particles are normally difficult to control. As disclosed herein, control over the energy of neutral particles in a beam is achieved by tuning the energy of the photons used to stimulate hyperthermal emission and/or by velocity selection to separate near-thermally emitted neutral particles from hyperthermally emitted particles. Velocity selection may also be used to narrow the energy distribution of either near-thermal or hyperthermal particles.

In a disclosed embodiment, excitation of a halide with photons having an energy less than a bulk absorption threshold of the solid halide and greater than a surface absorption threshold of the solid halide is used to provide an energy-tunable (velocity-tunable) beam of neutral halogen atoms. Photons at these energies are resonantly absorbed by the surface and predominately stimulate hyperthermal emission of ground state neutral halogen atoms. Tuning the photon energy between the bulk absorption threshold of the solid halide and the surface absorption threshold (believed to arise from surface excitons) of the halide serves to alter the kinetic energy of the emitted hyperthermal halogen particles. Thus, such beams may be used to provide halogen particles with specific energies for applications in selective etching and in mechanistic studies of surface reactions between halogen particles and substrate surfaces.

In addition, controllable amounts of ground state and excited state neutral halogen particles may be produced using the disclosed sources. For example, the emission yield of ground state and excited state particles may be controlled using frequency (energy) selected photon pulses and by application of sequential pulse pairs. The frequency selective approach takes advantage of the energetic differences between surface and bulk exciton states. For example, excitation with photons having an energy above the bulk absorption threshold of a halide sample provides a higher amount of excited state atom emission, presumably due to deposition of excess energy in the emitted atom. The two-pulse approach relies upon production and manipulation of transient species within the solid itself or near the crystal surface. Together, these techniques enable a solid state source of neutral halogen atoms that may be tuned to provide varying amounts of ground state and excited state atoms.

In addition to control over the type of particles produced by the disclosed sources, methods for the control of the flux of the particle beam by altering the photon flux incident on the halide surface are disclosed.

Control over the trajectories of neutral particles in the disclosed particle sources is provided, in part, by a newly discovered feature of photostimulated hyperthermal emission. Namely, photostimulated hyperthermal emission from insulator surfaces exhibits a higher degree of spatial definition than near-thermal emission. Unlike near-thermal emission, which provides particles with largely random trajectories, hyperthermal emission occurs in spatially defined, dense plumes of particles. In these plumes, the particle trajectories are substantially distributed about a normal relative to the surface of the solid, with the highest number of particles having a trajectory substantially along the normal. For a single crystal, the normal is substantially perpendicular to the cleaved surface of the single crystal struck by the photons, and, for a polycrystalline solid, the normal is substantially perpendicular to the substrate on which the polycrystalline sample is deposited. In some embodiments, most of the hyperthermally emitted particles have trajectories within a cone of about 50° about the surface normal.

Directed emission of hyperthermal particles is exploited to provide a beam of neutral particles and differences in directionality between near-thermal and hyperthermal emission may be exploited to separate near-thermal from hyperthermal particles. For example, an aperture arranged to allow passage of the plume of hyperthermal particles and prevent passage of near-thermal particles with trajectories at large angles from the normal to the surface may be used to separate the two types of particles. In combination with a tunable photon source, spatial selection of hyperthermally emitted particles provides a directed beam of energy-tunable neutral particles. A velocity selector may be used to further refine the beam's energy and to increase its purity. Velocity selection alone may be used if desired.

Beams of particles comprising hyperthermal plumes of halogen particles may be used to etch or otherwise react with target surfaces, such as semiconductor surfaces, by positioning the target surface to receive the hyperthermal particles. Materials used in the semiconductor industry that may serve as targets for hyperthermal beams of halogen particles may, for example, include silicon, II–VI compounds, III–V compounds, aluminum compounds, germanium compounds, metals, nitrides, oxynitrides, and silicides, and combinations thereof. Particular examples may, for example, include GaAs, GaSb, InP, GaP, SiN, and TiN. Additional particular examples may be found, for example, in "*Handbook Series on Semiconductor Parameters*" vols. 1 and 2, edited by M. Levinstein, S. Rumyantsev and M. Shur, World Scientific, London, 1996, 1999.

Some advantageous features of certain embodiments of the disclosed particle sources may include high intensity, low cost, small size, directional emission, velocity (energy) control, and variable ground/excited state ratios. For example, in specific embodiments, beams of bromine atoms having concentrations of at least $10^{13}$ atoms/cm$^3$ are provided. Since the halogen atom sources are solid state sources requiring no precursor gas or molecular beam, high vacuum conditions can be maintained with minimal pumping.

EXAMPLE 1—BROMINE PARTICLE GENERATOR

With reference to FIG. 1, an embodiment of a halogen particle generator 100 includes a laser 102 to output a laser beam 104. Although lasers may be preferred in some embodiments, other photon sources, including non-coherent sources, may also be employed. For example, xenon and mercury lamps may be used to provide photons with appropriate energies. In one embodiment, the laser beam 104 irradiates a sample 114 of potassium bromide (KBr) at room temperature, using nanosecond laser pulses (e.g. 3 to 8 nanosecond duration). Photons of the laser beam 104 may be produced at selected wavelengths by using any type of laser, for example, a dye laser (e.g. pumped by a Nd:YAG, $N_2$ or excimer laser or a flash lamp), an Optical Parametric Oscillator (OPO), a tunable Ti:Sapphire laser, a Nd:YAG laser, an excimer laser, a nitrogen laser, or a laser beam that is Raman-shifted from its characteristic frequency (e.g. in hydrogen gas) or frequency mixed with itself or another laser beam to provide, for example, a frequency doubled, tripled, or quadrupled beam. The laser beam 104 may be pulsed or continuous, and may be tuned to stimulate desorption of halogen particles from a surface layer of a solid halogen sample 114, in manners to be described.

In one embodiment, the halogen sample 114 is potassium bromide (KBr). Samples of other alkali halides, such as potassium iodide (KI), sodium chloride (NaCl) and potassium chloride (KCl) may also be employed. In general, the sample 114 may comprise any alkali halide sample, and may be either a single crystal or a polycrystalline sample. A single crystal sample may be cleaved in air and mounted in a vacuum chamber 112. The sample may be annealed to clean and purify the surface. Various annealing temperatures may be employed according to the sample and application. In one embodiment involving KBr, the sample may be annealed by heating the sample to about 650 Kelvin.

In another embodiment, the sample 114 is a thin film of an alkali halide or other material applied to a base material (e.g. glass, silica, polymer, metal) and mounted on a rotating, heatable mount 108. The sample 114 may be rotated and/or shifted in a continuous fashion to expose different areas of the surface to the laser beam 104. In yet another embodiment, the sample 114 may be a thin film of an alkali halide extruded, coated, or otherwise deposited onto an adhesive and streamed past the laser beam 104. In still further embodiments, sample 114 is a single crystal of an akali halide mounted to rotating, heatable mount 108. The sample may be a powder of an alkali halide and may comprise a mixture of one or more alkali halides. Sample 114 may also comprise a metal oxide sample, such as an MgO sample.

The particle generator 100 may be configured in any manner that allows a photon flux to be applied to the surface of sample 114. Since efficiency of photostimulated desorption from the sample surface can decrease as the total photon dose delivered to the surface increases, it may be desirable to provide for translation of the incident photons to new positions on the sample during operation of the particle source. Either the sample itself may be moved to expose a "fresh" surface to the incident photons, or the photon beam may be moved to a different location on the sample, or both. For example, as an alternative to rotating, translating, or streaming the sample, the photon flux itself could be rotated and/or translated in a continuous or discontinuous fashion to strike a new position on the sample. Herein, "continuous" means that the sample and/or photon flux are translated, rotated, or otherwise adjusted such that the area of the sample at which the flux is applied changes at a sufficiently continuous rate. The area at which the photon flux is delivered need not be continuously changed, although avoiding discontinuities in the change rate may lead to a more uniform yield, narrower velocity profile, and improved purity of the beam 124.

In one embodiment, a film of a polycrystalline alkali halide material having a minimum thickness of about 5 atomic layers is deposited on a substrate. Thin films may be produced, for example, by dipping a substrate into a solution of the alkali halide, removing the substrate from the solution, and allowing the adsorbed solution to evaporate. Thus, a thin layer of polycrystalline alkali halide is adsorbed to the substrate. Thicker films may result in waste of source material, but could also be employed beneficially, either on adhesive or on other substrates (such as disks or plates).

Laser beam 104 passes into the high-vacuum chamber 112 through window 106 (which passes at least a portion of laser beam 104) and irradiates the sample 114. The chamber 112 may be vented through an opening 110. In some embodiments, window 106 is transparent to photons having ultraviolet energies.

Particles desorbed hyperthermally from the sample 114 provide a beam 124 that may be preferentially directed along a direction substantially normal to the surface of the sample 114. The beam 124 may be further shaped and directed, for example, by passing the beam 124 through collimating means 116, which in the illustrated embodiment is an aperture. Collimation may not only serve to further direct and spatially define beam 124, but it may serve to separate hyperthermal particles from thermal particles that may or may not be present in beam 124. Spatial separation of thermal and hyperthermal particles is possible because thermal emission is less directional than hyperthermal emission. Thermal emission (which in some instances may be substantially described by a cos θ distribution about the normal to the surface) may exhibit a much broader spatial distribution than hyperthermal emission. Thus, an aperture arranged above the sample in a position to substantially accept the hyperthermal particles may remove at least some of the thermal particles from the beam, leading to an increase in the relative amount of hyperthermal particles in beam 124.

Other means of collimation may also be employed in place of an aperture. For example, control over a hyperthermal particle beam's shape and direction may be gained by converting the neutral particle beam into a beam of ions (for example, by photoionization or chemical ionization). The beam of ionic particles may be shaped and directed (e.g. collimated and/or focussed) using ion optics (similar, for example, to the ion optics of a mass spectrometer) and then converted back into a beam of neutral particles, for example, using an electrospray or collisional process. If particles are converted to ions, additional control over particle kinetic energy may be obtained, for example, by accelerating or decelerating the ionic particles within an electric field, prior to converting the particles back to neutrals. Additional electric field regions may be used to separate (e.g. deflect) ions not converted back to neutrals from the beam of neutrals.

Electric field generators and ion optics may also be components of the source where, for example, high photon fluxes are employed and ionic particles are desorbed along with hyperthermally emitted particles. For example, a pair of parallel conductive plates arranged along either side of beam 124 may be added between sample 114 and collimating means 116. If collimating means 116 is an aperture, an electric potential applied between the parallel plates will deflect ions within beam 124 away from the aperture, thereby blocking their transmission to target 120.

A velocity filter 118 (for example, a 'chopper' comprising spinning blades) may be employed to stop and/or deflect slower-moving particles and to permit passage of particles having a narrow range of velocities (or kinetic energies). For example, the velocity filter may be employed to remove slower-moving 'thermal' particles, such as near thermal halogen atoms and neutral potassium particles. The production of thermal particles is more fully described below.

The beam 124 is incident upon a target 120 mounted on a target mount 122. The target mount 122 may rotate and/or translate the target 120 to distribute the incident particles across the surface of the target 120 in a controlled fashion. In one embodiment, the target 120 may comprise a layer of semiconductor material to etch. For example, the target 120 may comprise a silicon wafer or other semiconductor material.

In one embodiment where the sample is KBr, the particle beam 124 comprises hyperthermal velocity (henceforth, 'hyperthermal') ground state $Br(^2P_{3/2})$ particles (henceforth, Br) and hyperthermal spin-excited $Br(^2P_{1/2})$ particles (henceforth, Br*). The beam 124 may also comprise thermal velocity particles. Thermal-velocity K, Br, and Br* particles may be present in the beam 124. Herein, the terms "thermal velocity," "thermal" and "near-thermal" refer to particle velocities substantially in the range of velocities that the particles may be expected to assume when heated to a particular temperature. The terms "hyperthermal velocity" and "hyperthermal" refer to particle velocities exceeding the expected thermal velocity range.

As previously described, thermal particles may also be desorbed. For example, desorbed thermal alkali metal particles and thermal halogen particles may be separated from hyperthermal particles using velocity filter 118. Separating the thermal particles from the particle beam 124 may produce a purer beam of hyperthermal particles (by removing, for example, thermal halogen particles and alkali metal impurities), and may serve to narrow the velocity distribution of the selected particles.

In one embodiment, photons having an energy greater than the surface absorption threshold are used to induce hyperthermal particle desorption from a thin (2–3 plane) surface layer of the sample. Theoretically, this surface desorption process may be described according to a model in which the absorption threshold for the surface of the alkali halide sample is shifted below the absorption threshold of the bulk alkali halide sample. In this model, the lower surface absorption threshold may be attributed to surface structure irregularities (such as terraces, steps, and corners) that have lower band gap energies than the bulk crystalline sample. The surface absorption band of the sample surface may comprise a range of photon energies that stimulate hyperthermal desorption of particles from the sample surface. The bulk absorption band of the sample may comprise a range of photon energies that stimulates both thermal and hyperthermal desorption from the sample. In some instances, the surface and bulk absorption bands overlap to some extent.

Selective excitation of the surface absorption band may narrow the velocity distribution of the particles emitted from the sample. Selective excitation may be used for applications benefiting from a narrow particle velocity distribution, such as etching, where the exposure rate of the target to the particles is precisely controlled. Thus, in some embodiments, the sample surface is exposed to photons having an energy that is greater than a surface absorption threshold energy but lower than a bulk absorption threshold energy. Excitation of the sample with photons having these energies may provide reduced or no emission of thermal particles, thereby narrowing the velocity distribution of the particles in beam 124. In particular embodiments, selective excitation of the surface absorption band provides a substantially pure source of hyperthermally emitted particles.

Selective excitation of a sample's surface absorption band may also be used to control the average velocity of hyperthermal particles emitted from the sample. In some embodiments, a tunable, narrow bandwidth photon source, such as a laser, is used to control the average velocity of hyperthermal particles. Tuning the photon energy between the surface absorption band threshold energy and the bulk absorption band threshold energy changes the average velocity of the particles provided by the source. For example, in particular embodiments, selective excitation of an alkali halide sample's surface absorption band provides a spatially defined plume of hyperthermal halogen particles that have an average velocity that is directly proportional to the energy of the incident photons.

In some embodiments, the number of hyperthermally emitted particles produced by the source is controlled by controlling the flux of photons striking sample 114. For example, the number of hyperthermal halogen atoms emitted by an alkali halide sample may be altered by changing the intensity of photon beam 104. In working embodiments, selective excitation of the surface absorption band of an alkali halide provides a source of neutral, hyperthermal halogen atoms where the intensity of the hyperthermal halogen atom beam is directly proportional to the photon flux incident on sample 114. However, increasing the photon flux may also increase the amount of thermal particles in beam 124 if the photon flux is high enough to stimulate multiphoton excitation of the bulk alkali halide sample. Multiphoton processes may be detected by increased emission of thermal particles or by considering the dependence of the particle flux on the photon flux. Multiphoton processes show a non-linear dependence (such as quadratic for a two-photon process) of particle production on photon flux, so they may be detected by deviations from linearity. In other words, when the photon energies employed fall within the surface absorption band, but outside of the bulk desorption band, desorption of particles from deeper layers (i.e. from the bulk) of the sample may nonetheless occur due to multiphoton excitation of the bulk sample. The number of thermally desorbed particles in beam 124 may be substantially reduced by lowering the photon flux intensity to within a range of photon fluxes where particle production is linearly related to photon flux. The number of thermal particles in beam 124 may be reduced further by exploiting the low directionality of the thermal particles relative to hyperthermal particles and their lower velocities relative to hyperthermal particles.

Selective multiphoton excitation of the surface absorption band is also possible. For example, in KBr, tunable hyperthermal bromine particle emission is stimulated in a one-photon process by photons having energies from about 5.5 eV to about 6.5 eV. Multiple photons, that together provide a total energy within this range, may also be used to stimulate tunable bromine particle emission from KBr. For example, two 3 eV photons that provide a total of 6 eV when absorbed simultaneously may be used to excited the surface absorption band.

Figure 2:
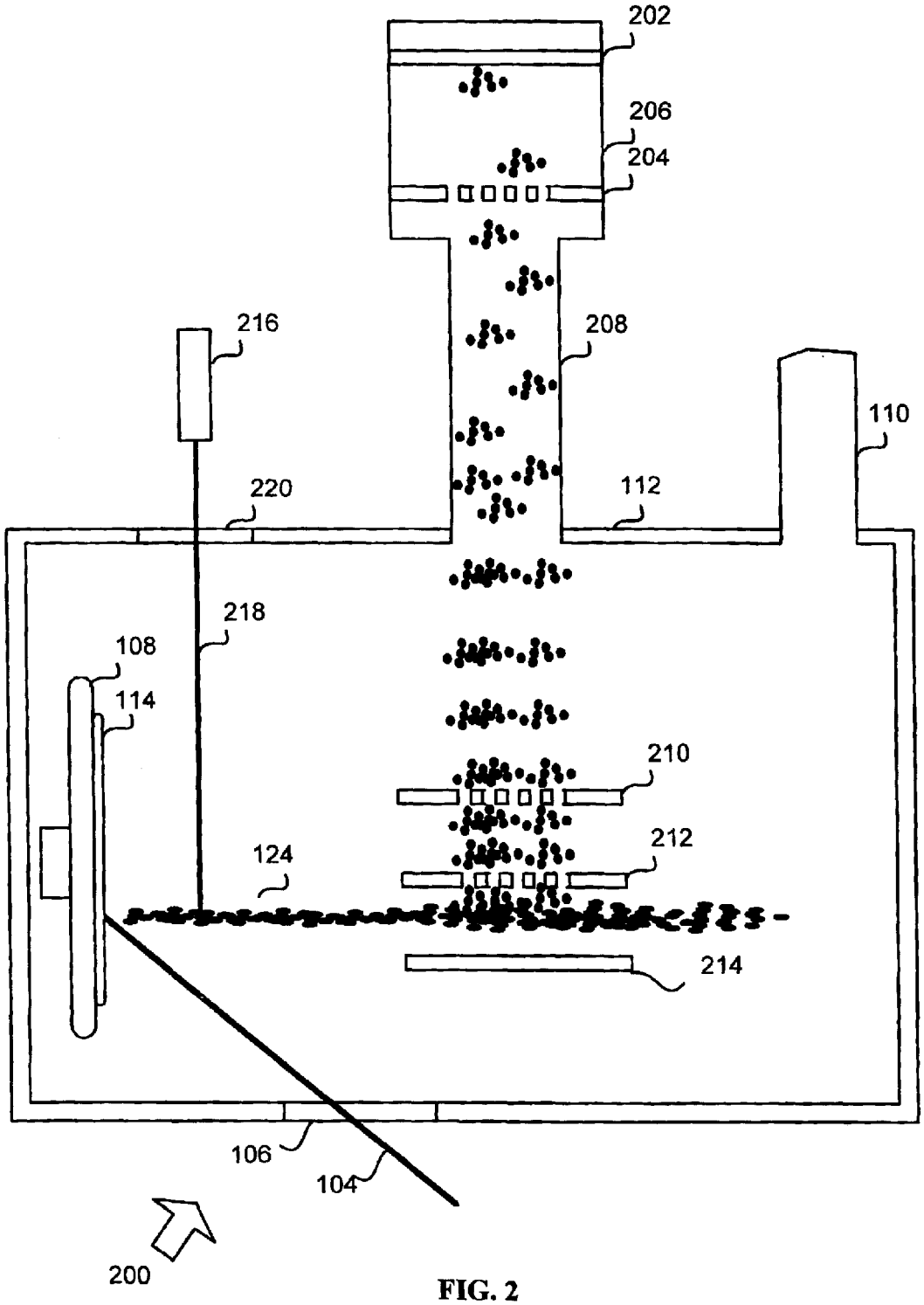
FIG. 2 illustrates an embodiment of an apparatus that may be used to characterize halogen particles emitted from a halide surface.

With reference to FIG. 2, an embodiment 200 of a measurement apparatus to characterize the beam 124 comprises a second laser source 216 providing a beam 218 to irradiate the particles of the beam 124 through a second window 220 of the vacuum chamber 112. Irradiation by the beam 218 results in photoionization of particles of the beam 124. Laser beam 218 may intersect particle beam 124 at any point, however, in a particular embodiment, laser beam 218 intersects the particle beam 124 approximately 3.8 millimeters from, and parallel to, the sample surface. Laser beam 218 may be provided by any suitable laser source 216. In particular embodiments, laser source 216 may be a dye laser (e.g. pumped by a Nd:YAG, $N_2$ or excimer laser or a flash lamp), an Optical Parametric Oscillator (OPO), a tunable Ti:Sapphire laser, a Nd:YAG laser, an excimer laser, a nitrogen laser, or a laser beam that is Raman-shifted from its characteristic frequency (e.g. in hydrogen gas) or frequency mixed with itself or another laser beam to provide, for example, a frequency doubled, tripled, or quadrupled beam.

In one embodiment, where the particle beam 124 comprises Br and Br* particles, the particles are ionized using a laser beam from a Nd:YAG-pumped frequency-doubled dye laser pulsed at a low frequency, such as at a frequency of 20 Hertz. Pulses of the laser beam 218 may produce "packets" of ions within the particle beam 124. These ionized packets may pass through an electric field produced by a charged plate and grid that are substantially parallel to each other and the direction of beam 124. Depending upon the direction of the electric field produced between the plate and grid, and the charge on the ions themselves, ions may be repelled from plate 214 toward grid 212. The grid 212 may be referred to as an extraction grid.

From the extraction grid 212, the ionized particles are accelerated toward a more highly charged grid 210. This more highly charged grid 210 may be referred to as an acceleration grid. Together, the plate 214 and the grids 212, 210 form a particle collector. One example of such a particle collector is a Wiley-McLaren two-stage particle accelerator. Other types of particle collectors known in the art may also be employed. The ionized particles separated from beam 124 using the particle collector may be directed to a measuring device or used as a source of ionic particles.

In the embodiment of FIG. 2, the collected ionized particles enter a flight tube 208 of a time-of-flight mass spectrometer. In particular embodiments, the flight tube is a vacuum region having substantially no electric field. Lighter particles travel faster than heavier ones through the flight tube 208, and thus particles tend to segregate by mass as they travel down the flight tube 208. The particles enter a detector 206 by passing through an entry grid 204 to strike a detector plate 202. The detector plate 202 may be referred to as a microchannel plate or MCP. Collisions of the particles with the MCP 202 result in free electrons that cascade down the MCP 202 to create an electric current. Each mass-grouped collection of particles thus produces a current spike that may be measured to determine the yield (number) of particles by mass.

By measuring the particle yield, particle velocity and beam shape, a better understanding of useful exposure times, photon flux intensities and photon energies may be obtained. For example, in etching applications, characterization of the particle beam 124 may lead to a better understanding of the precise amount of time to expose an area of the target to the particle beam 124, before shifting or rotating the target. Such knowledge may also assist in the selection of the photon flux intensity and photon energies at which to expose the alkali halide or metal oxide sample 114, due to the fact that particle yield tends to increase with flux intensity (see below) and particle velocity and identity tend to depend upon the incident photon energy.

Figure 3:
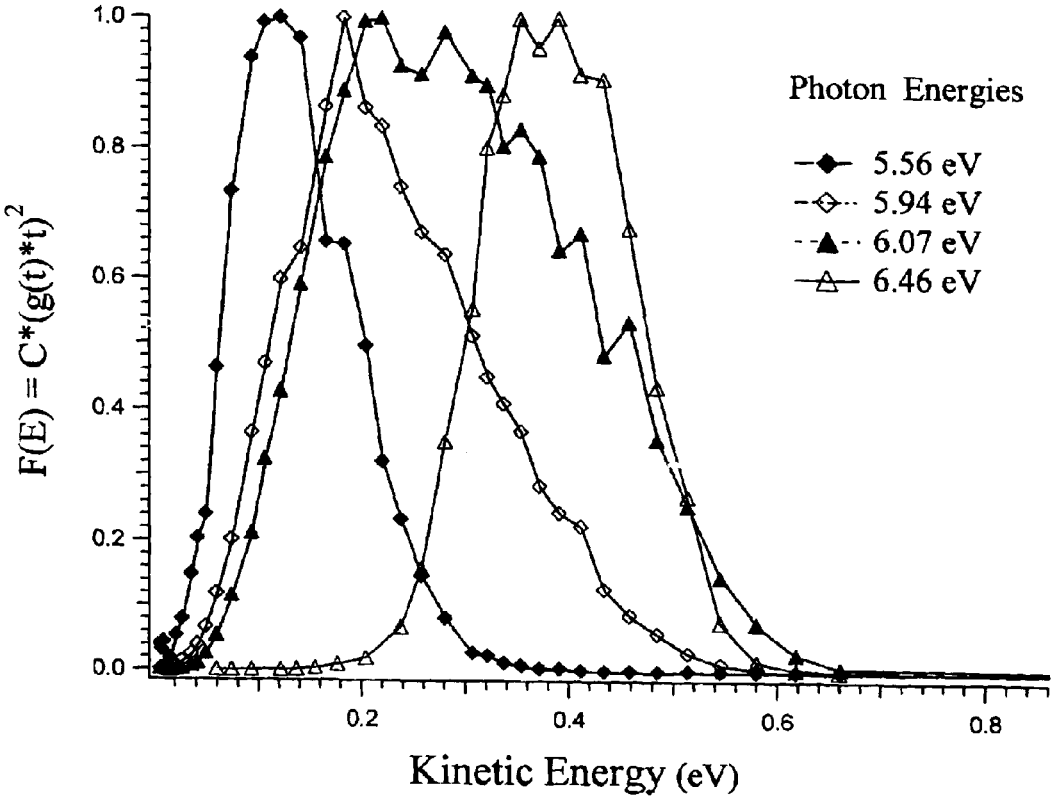
FIG. 3 is a graph illustrating the kinetic energy distribution of emitted bromine particles as a function of the energy of incident photons striking a KBr sample.

FIG. 3 illustrates velocity distributions of particles produced in working embodiments of a bromine particle generator as measured using the device embodied in FIG. 2. The velocity distributions of FIG. 3 were obtained with the device of FIG. 2 by varying the time delay between the laser pulse used to stimulate particle desorption from the sample and the laser pulse used to ionize the desorbed particles. Faster moving particles (higher kinetic energies) are selectively ionized when the delay time is short, whereas slower moving particles are selectively ionized when the delay time is longer. The detected signal is a function of the number of particles ionized by laser beam 218 of FIG. 2. Thus, plotting the detected signal as a function of delay time between the desorption laser and the detection laser provides a curve that reflects the velocity (kinetic energy) distribution of the desorbed particles. The curve shown in FIG. 3 was calculated from the raw experimental data by transforming the time-of-flight signal response function g(t) from time to velocity space through the Jacobian for density-sensitive detection (1/t). Conversion gives the energy distribution $f(E)=C^*[g(t)^*t]^2$, where C is the nomalization constant (see, for example, Auerbach, D., *Atomic and Molecular Beam Methods,* G. Scoles, ed., Volume I, Oxford University Press, Oxford, 1988).

FIG. 3 demonstrates that peak halogen particle velocity (kinetic energy) may be controlled according to the energy of the incident photons. In this embodiment, the illustrated curves are for photon energies that selectively excite the surface absorption band of a KBr sample. Note the absence of a thermal/near-thermal velocity component (at about 0.03 eV) indicative of bulk excitation. The peak kinetic energies of the emitted Br particles are around 0.37, 0.24, 0.18, and 0.12 eV for photon energies of around 6.46, 6.07, 5.94, and 5.56 eV, respectively. In this embodiment, the relative yield of Br* particles for each of these photon energies is less than around 0.5%; hence, a nearly pure neutral Br particle source is produced. The yield of Br* may be increased by employing higher photon energies, such as photon energies of 7.9 eV, or by employing a double-excitation scheme involving sequential illumination bursts of lower photon energy (see Example 5 below). Certain etching processes may be more efficient using Br*, since it is expected to be more reactive than Br in some instances. For mechanistic and kinetic studies, a source of both Br and Br* may be useful.

Velocity control may be useful in studies of halogen particle reaction dynamics or in controlling surface etching rates. For example, selective etching of a surface orientation or structure may be achieved. Etching rates may depend on the orientation of the target. For example, the different crystal axes (e.g., (100) and (111)) of a semiconductor substrate may etch at different rates (faster or slower). There also may be a threshold energy for etching that depends on the velocity of the halogen particles and the orientation of the etched sample. By combining a directional beam of controlled velocity halogen particles with an oriented crystal sample, selective etching along a particular crystal axis may be achieved to the substantial exclusion of etching along other axes. Such controlled etching provides finer features with fewer defects.

As the photon energy is decreased from 6.46 eV to 5.56 eV, the halogen particle yield decreases substantially on a per-photon basis. For example, the Br yield at around 5.56 eV is less than about 1% of the yield at about 6.46 eV for equal photon fluxes at the sample surface. However, the Br particle yield is substantially linear with photon flux for photon energies above about 5.55 eV. Thus, the lower yield at lower photon energies may be compensated for by increasing photon flux at these lower energies. This provides application flexibility by controlling particle yield according to at least two variables: photon energy and flux intensity.

Low cost, small sized, velocity (kinetic energy) tunable, directed halogen particle generators, having high particle yield, are provided based on the discoveries described herein. For example, the disclosed directionality of hyperthermal emission may be exploited to provide a directed particle beam of neutral particles. Yield (e.g. particle intensity) may be controlled by varying the photon flux intensity, and the kinetic energy of the particles may be varied by changing the photon energy. In particular, the purity and velocity distribution of the particle beam may be precisely determined by selecting a photon energy that is above the surface absoprtion threshold and below the bulk absorption threshold of the alkali halide sample.

EXAMPLE 2—HALIDES FOR HALOGEN ATOM SOURCES

In addition to KBr, the halide that was used for particular embodiment described in Example 1, samples of other halides, such as alkali halides and alkaline earth halides, may be used with the described apparatus to provide directed, intensity and energy tunable beams of neutral halogen atoms. In principle, photons of any energy that are absorbed (by single or multiphoton processes) by the solid material and lead to emission of hyperthermal halogen atoms may be used to provide a directed beam of halogen particles and to tune the energy of the particles. Nonetheless, excitation of solid alkali halides or alkaline earth halides with photons having an energy that is resonantly absorbed by the surface of the solid may be particularly advantageous for producing energy-tunable hyperthermal emission of halogen particles unaccompanied by significant thermal emission.

Selection of appropriate photon energies for surface specific excitation of halide samples may be guided by considering the absorption spectra of the halides. In this approach, the lowest energy peak in the absorption spectrum of the solid is identified and a photon energy about 0.2 eV below the energy of this bulk absorption feature is initially selected. In general, this should be close to the surface absorption band for the sample, and a good starting point for getting only the hyperthermal component. However, if a near-thermal component to the halogen atom emission is detected, the photon energy may be tuned to lower energies until the thermal component disappears. For example, since the lowest energy bulk absorption peak for RbI appears at about 5.7 eV, photons having an energy of about 5.5 eV may be initially selected.

The approximate energies of the lowest energy bulk absorption peak for alkali halides at room temperature are given in Table 1 below (see, Eby et al., "Ultraviolet Absorption of Alkali Halides," *Phys. Rev.,* 116: 1099–1105 (1959); see also Teegarden and Baldini, "Optical Absorption Spectra of the Alkali Halides at 10°K.," *Phys. Rev.,* 155: 896–907, (1967)). Comparison of low and high temperature spectra of the alkali halides reveals that the energy of the lowest bulk absorption peak tends to shift to lower energies as the temperature is raised. Photon energies identified by the procedure outlined above correspond roughly to the region of the spectra of the alkali halides known as the "Urbach tail."

An alkali halide sample as described herein may comprise, for example, any of the alkali halides appearing in Table 1 and mixtures and co-crystals thereof.

TABLE 1

| Alkali Halide | Approximate Energy of the Lowest Energy Bulk Absorption Peak at Room Temperature |
|---|---|
| LiF | 14.2 eV |
| NaF | 10.4 eV |
| KF | 9.7 eV |
| RbF | 9.3 eV |
| CsF | 9.2 eV |
| LiCl | 8.6 eV |
| NaCl | 7.8 eV |
| KCl | 7.7 eV |
| RbCl | 7.4 eV |
| CsCl | 7.4–7.6 eV |
| LiBr | 7.0 eV |
| NaBr | 6.5 eV |
| KBr | 6.6 eV |
| RbBr | 6.5 eV |
| CsBr | 6.6 eV |
| LiI | 6.8 eV |
| NaI | 5.4 eV |
| KI | 5.6 eV |
| RbI | 5.5 eV |
| CsI | 5.6 eV |

The electronic structure of the surface of a halide sample is largely determined by the halide ion itself. As shown in Table 1, the peak energy of the first halide exciton band is similar for a given halide regardless of the alkali metal used (Na, K, Rb, Cs), with Li being somewhat of an exception. Therefore, hyperthermal halogen emission may also result from excitation of many different halogen compounds and is not limited alkali halides. For example, other samples that may be suitable for providing hyperthermal halogen particle emission include the alkaline earth halides. This group of compounds typically satisfy the formula $MX_2$ where M denotes the metal and X denotes the halogen (i.e. M=Mg, Ca, Sr, Ba, and X=F, Cl, Br, I). Other divalent metals, such as Zn, Ni, Mn, Co, and Fe, also form compounds of formula $MX_2$, and may be used. Particular examples of suitable divalent metal halide samples include $MgF_2$, $CaF_2$, $SrF_2$, $BaF_2$, $MgCl_2$, $CaCl_2$, $SrCl_2$, $BaCl_2$, $MgBr_2$, $CaBr_2$, $SrBr_2$, $BaBr_2$, $MgI_2$, $CaI_2$, $SrI_2$, $BaI_2$, $FeF_2$, $FeCl_2$, $FeBr_2$, $FeI_2$, $ZnF_2$, $ZnCl_2$, $ZnBr_2$, $ZnI_2$, $NiF_2$, $NiCl_2$, $NiBr_2$, $NiI_2$, $MnF_2$, $MnCl_2$, $MnBr_2$, $MnI_2$, $CoF_2$, $CoCl_2$, $CoBr_2$, $CoI_2$ and mixtures and co-crystals thereof.

EXAMPLE 3—IODINE ATOM SOURCE

In this Example, photostimulated desorption of neutral iodine atoms from cleaved (001) single crystals of KI using tunable laser pulses is described. On the basis of the guidelines above, single photons near the KI ultraviolet absorption threshold (~5 eV) should selectively excite surface or near-surface excitons, leading to predominant desorption of hyperthermal I-atoms. Predominantly hyperthermal emission was observed at this photon energy and adjustment of the kinetic energy distribution of the emitted iodine atoms may be made by changing the incident photon energy in analogy to the bromine atom source described in Example 1. As described before, the photon energy selective approach takes advantage of energetic differences between surface and bulk exciton states to directly excite the surface exciton. Controllable iodine atom emission from KI using photons with energies below the bulk absorption threshold energy and above the surface absorption threshold energy demonstrates the generality of the approach for alkali halides.

Samples of single crystal KI (001) were cleaved in air and mounted in a UHV chamber with a base pressure of about $4\times10^{-10}$ torr. Samples were heated to about 450 K for 5–6 hours to anneal and clean the KI surface. The crystal was then irradiated at temperatures ranging between about 293 and about 450 K using nanosecond laser pulses derived from a broadband optical parametric oscillator (OPO) laser system that is frequency doubled to generate the necessary photon energies (excitation pulse). The desorbed atoms were detected using laser ionization combined with time-of-flight (TOF) mass spectrometry using the device of FIG. 2. Tunable light from a Nd:YAG pumped frequency-doubled narrow-band OPO laser, operating at 20 Hz, was used to ionize ground $I(^2P_{3/2})$ and spin-orbit excited $I(^2P_{1/2})$ atoms (henceforth designated as I and I*) in a (2+1) resonance-enhanced multiphoton ionization scheme (probe pulse). The specific two-photon transitions used were $I(^4D_{3/2})\leftarrow I(^2P_{3/2})$ at 304.58 nm and $I(^2S_{1/2})\leftarrow I(^2P_{1/2})$ at 305.49 nm. The focused probe pulse intersected the desorbed atoms approximately 3.8 mm above, and oriented parallel to, the sample surface.

Atomic masses were determined by a TOF mass spectrometer using chevron microchannel plates to amplify the ion signal. The output signal of the microchannel plates was input to a 500 MHz video amplifier (×10) and then sent to a digital oscilloscope. Data collection was computer controlled and the lasers could be independently delayed in time using computer interfaced digital delay generators to facilitate measurement of I and I* velocity distributions. Velocity profiles reflecting the velocity distributions of photodesorbed atoms were determined by integrating the atom yield as a function of the delay between excitation and probe lasers. The velocity profiles may be converted to kinetic energy distributions by applying the appropriate Jacobian transform. Each data point represents an average of the integrated mass selected ion signal from 200 laser pulses. Laser powers were determined using a pyroelectric detector.

Figure 4:
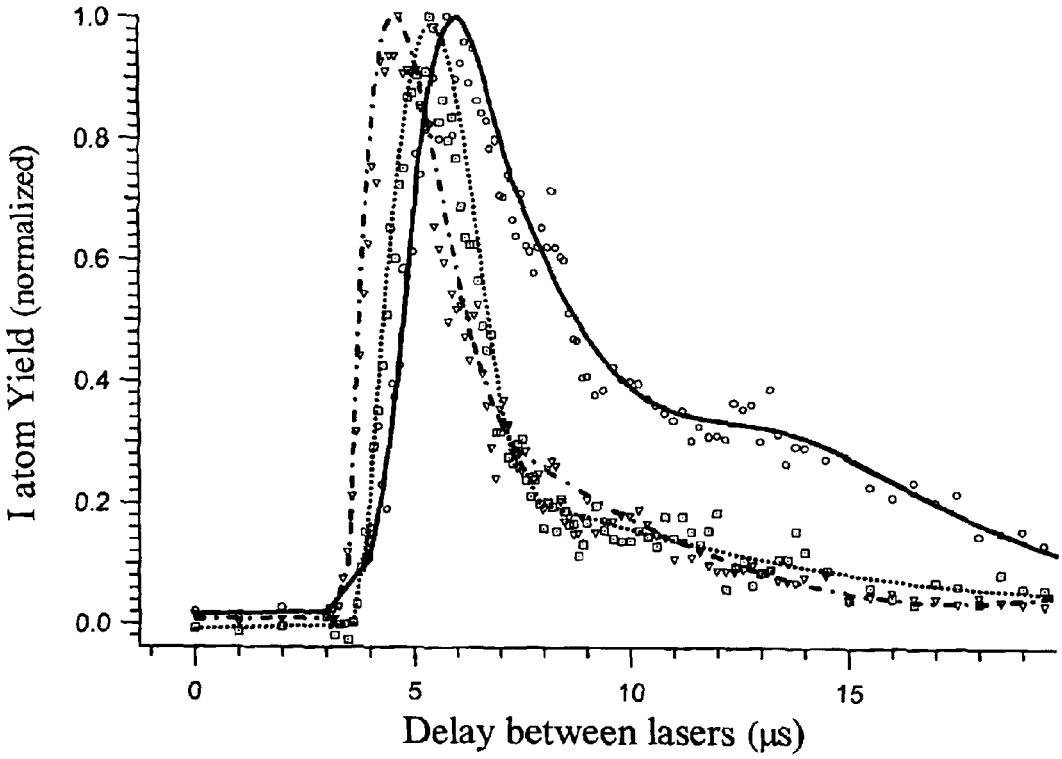
FIG. 4 is a graph illustrating the velocity distribution of emitted iodine particles as a function of the energy of incident photons striking a KI sample.
Figure 5:
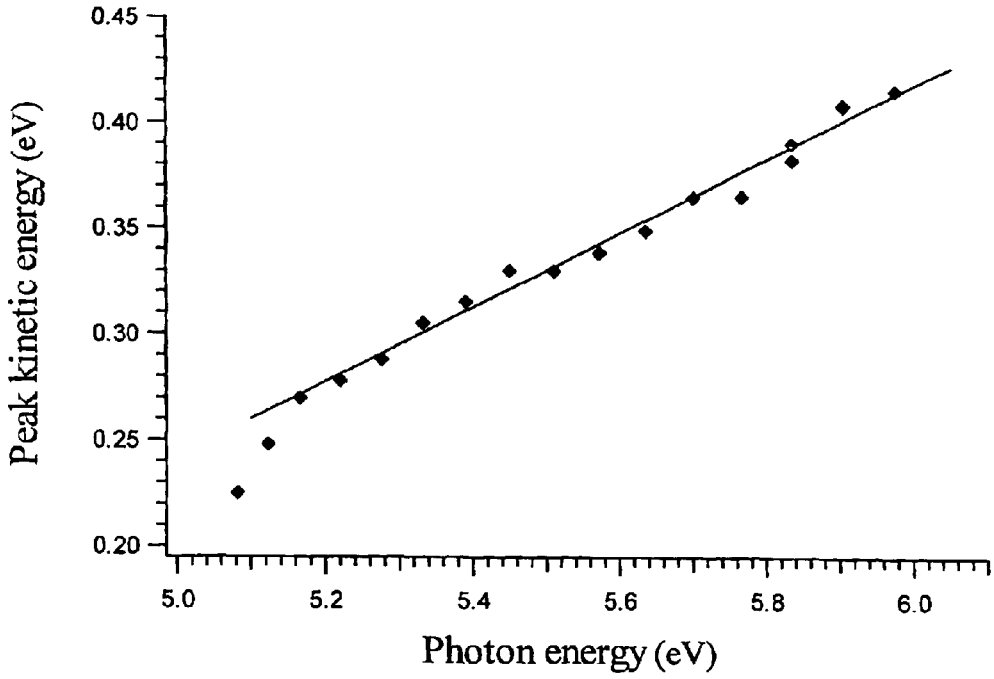
FIG. 5 is a graph showing the dependence of the peak kinetic energy of emitted iodine atoms as a function of the energy of photons striking a KI sample.

Excitation of KI single crystals leads to desorption of I, $K(^2S_{1/2})$, and a minor yield of spin-orbit excited I* atoms. Excitation of the surface using photon energies that overlap the long wavelength edge and first exciton band of the KI bulk absorption was performed. FIG. 4 displays the room-temperature I-atom velocity profiles obtained using excitation photon energies of 5.9, 5.45, and 5.12 (triangles, squares, and circles, respectively). The sharp peak in the velocity profile between 5 and 7 microseconds corresponds to the hyperthermal component while the smaller, broader distribution centered near 12 microseconds is due to the thermal component. FIG. 5 displays the peak I-atom kinetic energy, of the hyperthermal component, as a function of excitation photon energy. A roughly linear increase is observed between 5.2 and 6.0 eV and demonstrates that the I-atom kinetic energy can be controlled using selected photon energies as demonstrated previously in Example 1 for photostimulated bromine atom desorption from KBr. For any particular photon energy, the peak hyperthermal kinetic energy is constant, within experimental error, over the temperature range 293 to 450 K, although the thermal I-atom emission yield grows markedly over this range as expected (data not shown).

Figure 6:
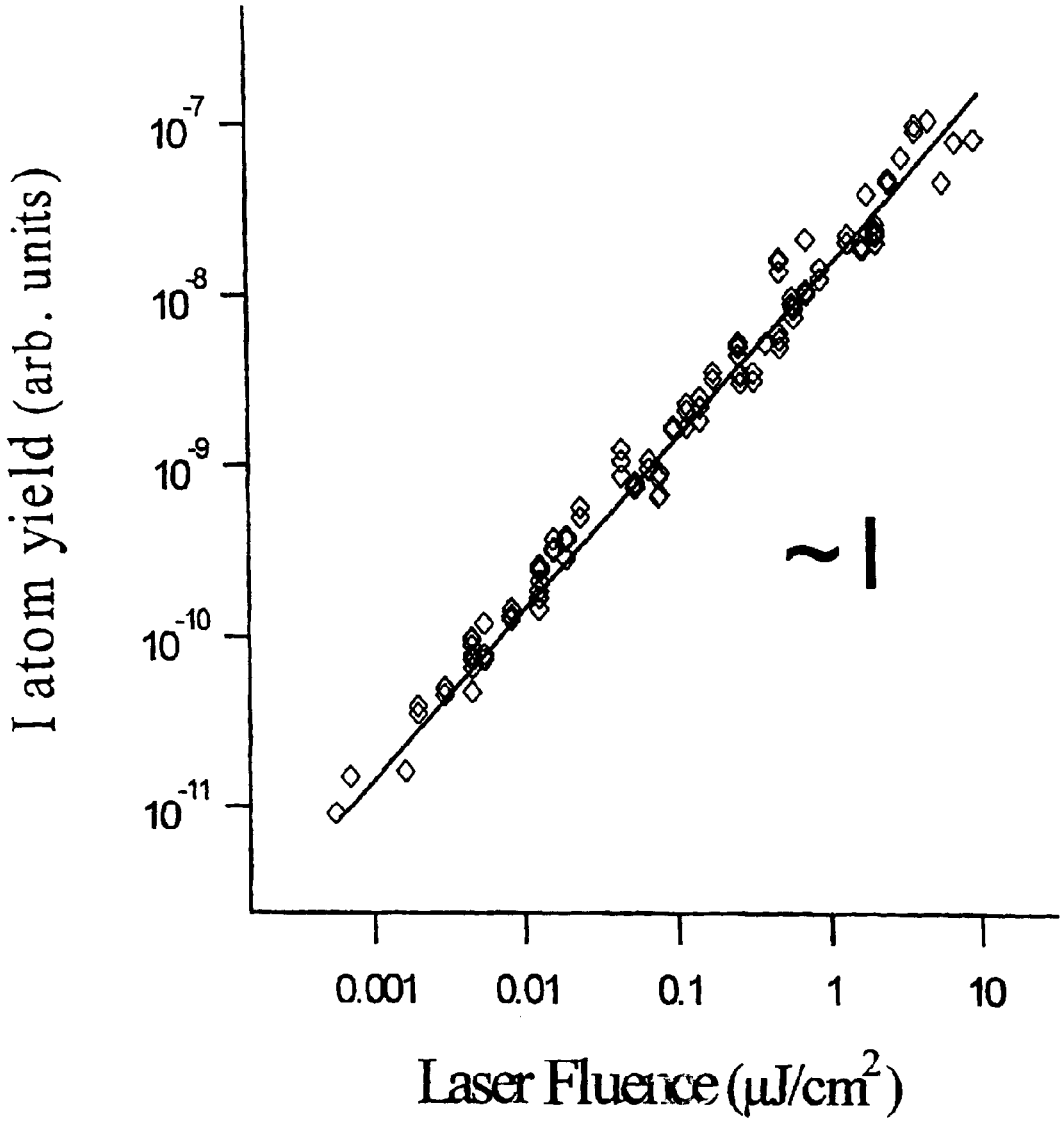
FIG. 6 is a log-log graph of the iodine atom yield versus photon fluence striking a KI sample that shows a linear relationship indicative of a one-photon process.

The absorption cross-section of KI decreases sharply between 5.7 and 5.1 eV and the I-atom emission yield also decreases sharply in this range on a per photon basis. The I-atom yield at 5.12 eV is less than 1% of that at 5.9 eV, for equal photon flux at the surface. FIG. 6 displays the dependence of the hyperthermal I-atom yield on excitation laser fluence. The yield is linear with photon flux in this region and therefore the reduced absorption at the lower photon energies—resulting in lower I yield—may be compensated for by increasing the photon flux. That is, the yield of I atoms may be controlled by laser fluence. However, there is a limit on this approach. If the photon flux is increased above the multi-photon threshold for bulk absorption, an increased contribution from the thermal component may result, leading to a bimodal velocity distribution. The detection threshold for I-atom photodesorption resulting from linear (single-photon) absorption, which roughly corresponds to the surface absorption threshold energy, occurs at approximately 5.1 eV at room temperature.

Photoexcitation of room temperature KI surfaces leads to I $(^2P_{3/2})$ emission in primarily hyperthermal kinetic energy distributions. Photoexcitation in the surface absorption threshold region is used to generate predominant ground state I emission. Furthermore, the kinetic energy distribution of laser-desorbed ground state I from KI surfaces may be selected through choice of the photon excitation energies. Kinetic energy distributions, with peak energies ranging from 0.25 eV through 0.42 eV, are generated using photon energies ranging from 5.2 to 5.9 eV and are believed to be characteristic of the decomposition of the KI surface exciton. That the kinetic energy tracks the exciting photon energy in a dynamical emission process indicates that the I-atom velocity distribution reflects the details of the adiabatic potential energy surface of the surface excited state. The photon energy dependent velocity profiles therefore may represent an indirect measurement of the adiabatic potential along the exciton decomposition coordinate. The fact that the emission yield follows a single-photon power dependence provides further support to a model wherein the iodine emission is caused by direct photon absorption at or near the surface followed by decomposition of a surface exciton.

Calculations on KBr and MgO demonstrate that the surface absorption threshold is shifted to lower energies from the bulk value, due to the lower coordination of terrace, step, and corner sites. Laser excitation tuned selectively to such a shifted resonance below the first bulk absorption band can therefore excite these surface features preferentially and possibly lead to particle emission. The hyperthermal I-atom emission is most likely derived from a thin near-surface layer, since the I-atom kinetic energy distribution would be expected to relax to a thermal distribution if I-atoms were required to diffuse long distances through the bulk prior to emission.

Controlled emission of I atoms induced by tunable UV excitation can be used as a source of these atoms with selected kinetic energies. The surface excitonic mechanism of photostimulated desorption is general for halides and active control using tunable laser pulses to generate halogen atoms of all types and selected kinetic energies is possible. In addition, excitation of other materials, including oxides such as MgO, where the surface has a band-gap energy lower than the bulk band-gap energy, may also be exploited to provide directional beams of hyperthermally emitted particles.

EXAMPLE 4—CHLORINE ATOM SOURCES

Figure 7:
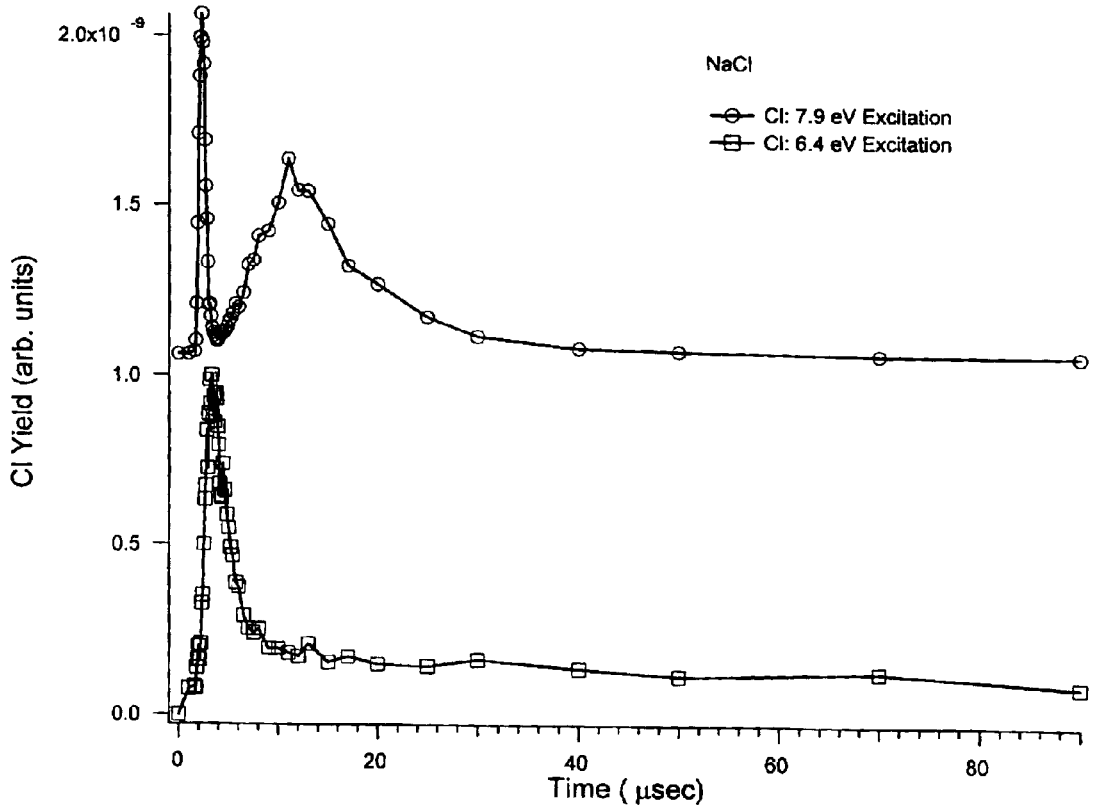
FIG. 7 is a graph showing the velocity distribution of emitted chlorine atoms as a function of the energy of photons striking an NaCl sample.

In addition to bromine and iodine sources, chlorine sources may also be based on stimulation of spatially defined hyperthermal halogen atom emission. For example, FIG. 7 shows the Cl velocity profiles for chlorine atom emission from NaCl stimulated at two different incident photon energies (6.4 eV and 7.9 eV). As shown in Table 1 above, the first bulk absorption peak for NaCl lies at an energy of 7.8 eV. The profiles once again demonstrate that absorption at energies below the bulk absorption threshold leads predominantly to hyperthermal emission while excitation at energies above the bulk absorption threshold leads to both hyperthermal and near-thermal emission.

EXAMPLE 5—SPIN STATE CONTROL OF HALOGEN PARTICLES

Pulse pairs may be used to enhance the relative Br* yield by selective excitation of transient centers near the crystal surface. Transient centers are generated in alkali halides using both resonant exciton excitation and cross band gap excitation to produce electron hole pairs. In this example, sub-resonant multi-photon excitation at 4.7 eV was used to create transient centers.

Irradiation at 4.7 eV (initial pulse) is below the surface and bulk absorption thresholds and excitation occurs principally through a two-photon process. The two-photon energy of 9.4 eV lies above the 7.4 eV KBr band gap such that bulk electron hole pairs ($e^-$-$h^+$) result. There was a significant yield of thermal Br atoms following 4.7 eV excitation. The Br yield versus laser power and thermal velocity distribution of desorbed Br atoms are both consistent with one-laser emission studies.

Transient centers generated in KBr can be electronically excited with 3.5 eV photons. Thus the initial 4.7 eV laser pulse can generate transient absorption centers and a delayed 3.5 eV pulse (second pulse) can further excite these centers. The pulse energy and delay time (e.g., 20 ns) of the second pulse may be selected to excite the newly formed transient centers at powers well below that required for forming such centers through a two-photon process. The energy at which such low energy transient centers may be excited may be found by tuning the second pulse until increased emission of excited state atoms are produced.

Figure 8:
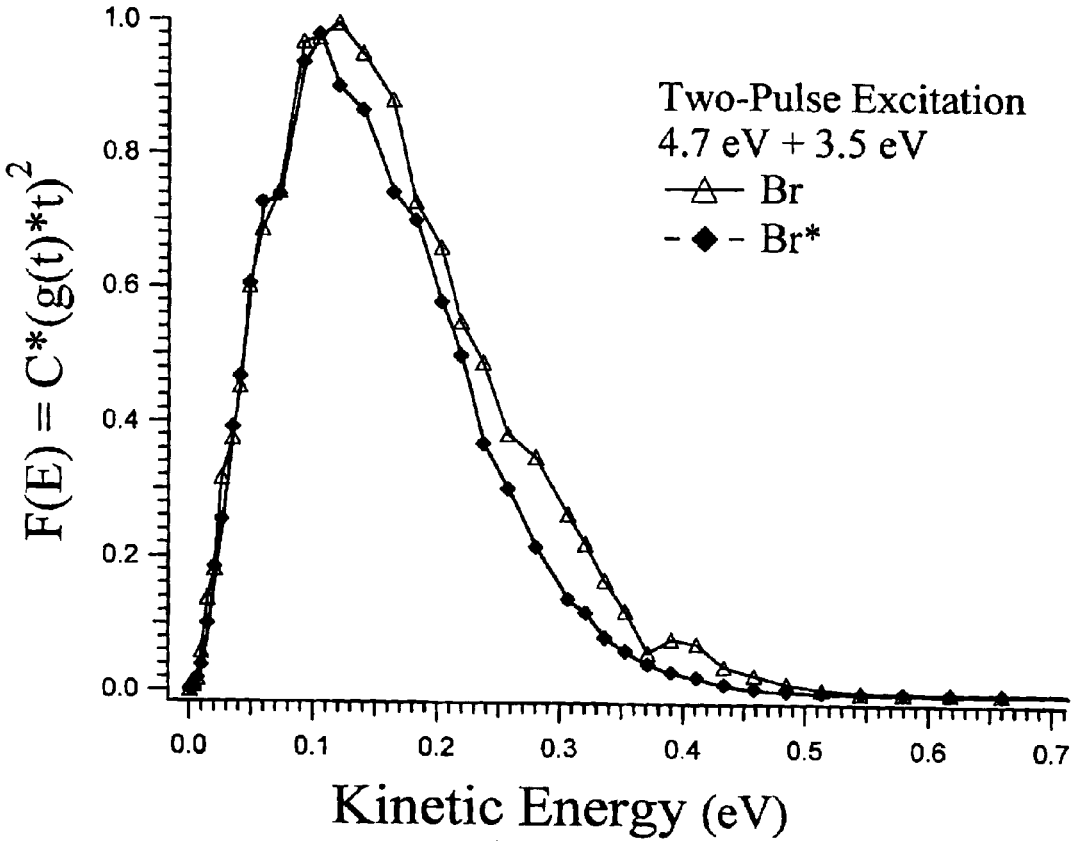
FIG. 8 is a graph showing the kinetic energy distributions of emitted ground state and excited state bromine atoms following pulse pair excitation of a KBr sample.

FIG. 8 displays kinetic energy distributions of desorbed Br and Br* atoms following sequential excitation by 4.7 eV (266 nm, initial pulse) and 3.5 eV (355 nm, second pulse) nanosecond laser pulses. The energy distribution for both spin states is remarkably similar. The peak kinetic energy is roughly 0.12 eV; well above that expected for thermal desorption but well below that obtained following resonant one-photon excitation discussed above. The relative Br/Br* product yield ratio resulting from two-laser induced emission (4.7 and 3.5 eV) is 1.4±0.6. The relative Br* yield is approximately 500 times greater than that obtained following resonant one laser excitation, although the total atom yield is much lower, approaching only 1% of the 6.4 eV yield. Br and Br* emission are also produced using 6.4 eV excitation followed by 3.5 eV nanosecond laser pulses. The Br and Br* kinetic energy distributions produced by this latter pulse combination are identical, within error, to those displayed in FIG. 8. However, when the second laser was tuned to 4.7 or 2.3 eV no significant increase in Br or Br* emission was observed, indicating that 3.5 eV corresponds to an energy at which transients in KBr absorb light.

Figure 9:
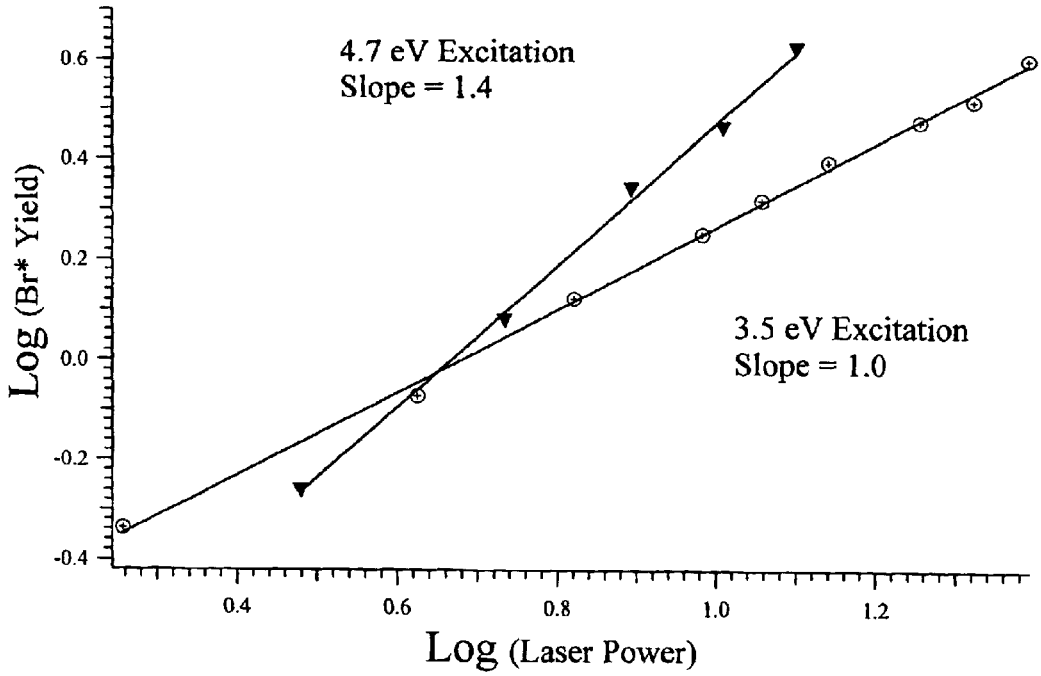
FIG. 9 is a log-log graph showing the dependence of excited state bromine yield on the laser power of each component of a pulse pair used to stimulate emission of excited state bromine atoms.

FIG. 9 displays the Br* yield versus laser fluence in log-log format. The Br* yield is linear with 3.5 eV laser fluence, indicating that the transient centers created by 4.7 eV photons absorb resonantly at 3.5 eV. The Br* yield follows a $P^{14}$ dependence with 4.7 eV laser fluence as found previously for 4.7 eV one-laser induced Br emission from KBr. This non-integer power suggests that, besides a two-photon cross-gap excitation, the 4.7 eV photons are absorbed in a one-photon process. However, the Br and Br* kinetic energy distributions resulting from two-laser excitation do not conform to hyperthermal or thermal components observed in the single pulse 4.7 eV experiments, and a new kinetic energy distribution is produced.

These results clearly demonstrate that active incoherent control of the properties of photo-desorbed halogen atoms from an alkali halide surface is achieved. For example, the velocity of Br atoms photo-desorbed from the surface of a cleaved KBr crystal is controllable using tunable laser light near the UV absorption threshold. The relative yield of Br to Br* can be enhanced, over single photon resonant excitation, using a pulse-pair excitation scheme.

Under the two-pulse 4.7+3.5 eV excitation, the Br/Br* ratio was determined to be 1.4±0.6, an increase in the relative Br* yield of roughly 500 from the single laser result at 6.4 eV. The similar velocity profiles and halogen atom yield of the two spin states suggest that both emissions result from excitation of the same transient center precursor. Thus, the Br/Br* ratio may be enhanced by using smaller time-delays between the initial and second pulses. Pulse delays of 100 microseconds or less, such as 50 microseconds or less may be utilized. For example, pulse delays of between about 5 microseconds and about 100 microseconds, such as between about 10 microseconds and about 70 microseconds, are suitable.

Controlled desorption of Br and Br* atoms induced by UV surface excitation can be used as a source of these atoms with selected kinetic energies for reactions with gas phase species, surface reactions and other purposes. Active control using a one- or two-laser approach may be used to generate halogen atoms of selectable kinetic energy or spin state distribution. Active control applied to laser desorption from oxides, such as MgO, is also possible.

EXAMPLE 6—MULTIPHOTON EXCITATION

In addition to stimulating emission of hyperthermal atoms using single photons it is possible to stimulate hyperthermal atom emission using a multiphoton processes. For example, two-photon excitation using photon energies that are one-half of those used to resonantly excite the surface of halide sample, may be employed.

Figure 10:
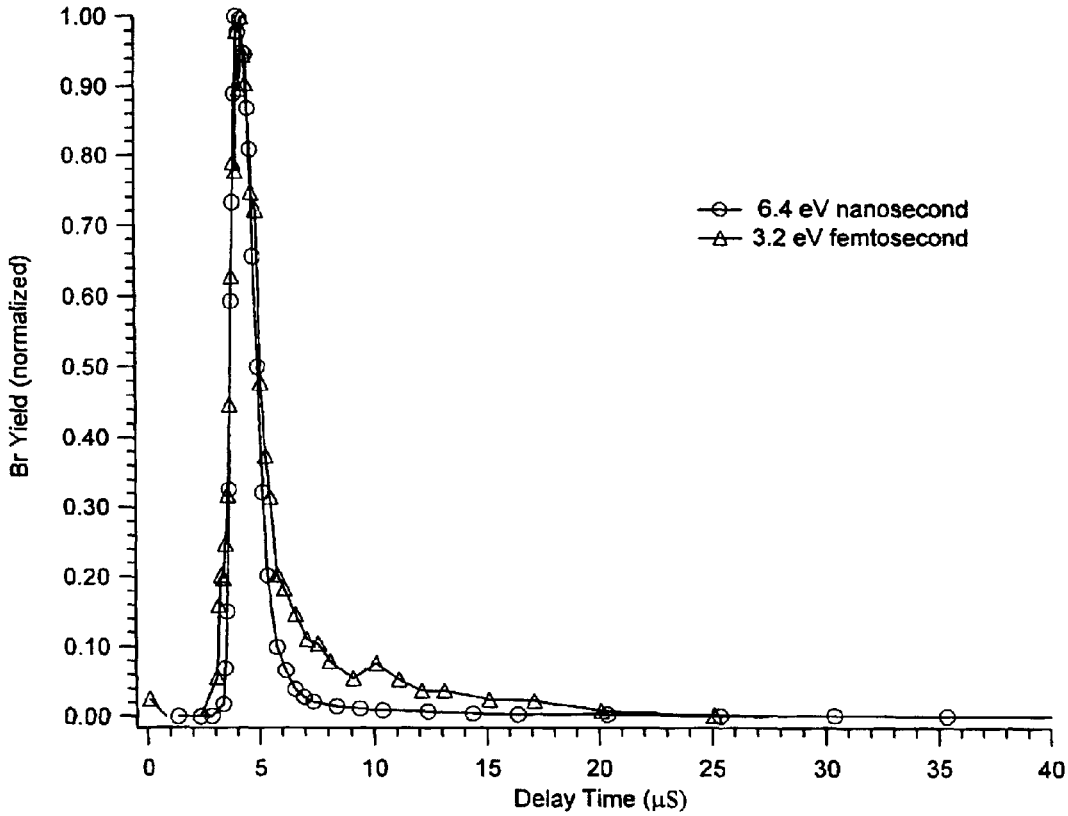
FIG. 10 is a graph comparing the velocity distributions of emitted bromine atoms stimulated by one-and two-photon excitation of a KBr sample.

FIG. 10 compares the bromine atom velocity profiles for one- (circles) and two-photon (triangles) excitation of a KBr single crystal. As before, single photon excitation using a nanosecond pulse of 6.4 eV photons provides hyperthermal emission substantially to the exclusion of a thermal emission component. Two-photon excitation with femtosecond (150 fs) pulses of 3.2 eV photons provides a similar velocity profile to that obtained with 6.4 eV photons, demonstrating that both single and multi-photon excitation may be used to stimulate hyperthermal emission to the substantial exclusion of a thermal component.

Because two-photon absorption is a non-linear effect, excitation using shorter pulses, such as femtosecond pulses, results in significant two-photon absorption relative to nanosecond pulses. While the energy delivered to a surface in a two-photon process may be the same as that delivered by single photons of twice the energy, it is not necessary that the photons have identical energies. Rather, it is only necessary that the sum of the energies of the photons absorbed corresponds to an energy that is absorbed by the sample.

Although described in terms of particular embodiments, the invention is defined and bounded only to the extent of the following claims.

We claim:

1. A halogen particle generator, comprising:

a solid halide sample;

a photon source positioned to deliver photons to a surface of the sample; and a collimating means positioned to accept a spatially defined plume of hyperthermal neutral halogen atoms emitted from the surface of the halide sample.

2. The particle generator of claim 1, wherein the photons have an energy less than a bulk absorption threshold energy of the halide sample and greater than a surface absorption threshold energy of the halide sample.

3. The particle generator of claim 1, wherein the collimating means comprises an aperture.

4. The particle generator of claim 1 further comprising a velocity selector.

5. The particle generator of claim 1, wherein the solid halide sample is an alkali halide sample.

6. The particle generator of claim 1, wherein the solid halide sample satisfies the formula $MX_2$ wherein M is a metal and X is a halogen.

7. The particle generator of claim 1, wherein the solid halide sample is selected from the group consisting essentially of LiF, NaF, KF, RbF, CsF, LiCl, NaCl, KCl, RbCl, CsCl, LiBr, NaBr, KBr, RbBr, CsBr, LiI, NaI, KI, RbI, CsI $MgF_2$, $CaF_2$, $SrF_2$, $BaF_2$, $MgCl_2$, $CaCl_2$, $SrCl_2$, $BaCl_2$, $MgBr_2$, $CaBr_2$, $SrBr_2$, $BaBr_2$, $MgI_2$, $CaI_2$, $SrI_2$, $BaI_2$, $FeF_2$, $FeCl_2$, $FeBr_2$, $FeI_2$, $ZnF_2$, $ZnCl_2$, $ZnBr_2$, $ZnI_2$, $NiF_2$, $NiCl_2$, $NiBr_2$, $NiI_2$, $MnF_2$, $MnCl_2$, $MnBr_2$, $MnI_2$, $CoF_2$, $CoCl_2$, $CoBr_2$, $CoI_2$ and mixtures and co-crystals thereof.

8. The particle generator of claim 1, wherein the solid halide sample is a single crystal of the halide.

9. The particle generator of claim 1, wherein the solid halide sample is a polycrystalline halide sample.

10. The particle generator of claim 1, wherein the halide sample is a thin film.

11. The particle generator of claim 2, wherein the hyperthermal neutral halogen atoms have an average velocity that decreases as the energy of the photons is decreased from the bulk absorption threshold energy to the surface absorption threshold energy.

12. The particle generator of claim 1, wherein the spatially defined plume of hyperthermal halogen atoms is emitted in a direction substantially normal relative to the surface of the halide sample.

13. The particle generator of claim 12, wherein the distribution of particle trajectories within the spatially defined plume is substantially within a 50° cone around a normal to the surface of the halide sample.

14. A tunable halogen particle generator, comprising:

a solid halide sample;

a tunable photon source arranged to deliver photons to a surface of the halide sample, the photons having an energy that is tunable between a bulk absorption threshold energy of the halide sample and a surface absorption threshold energy of the halide sample, the photons stimulating emission of hyperthermal neutral halogen atoms from the halide sample, the hyperthermal neutral halogen atoms having an average velocity that decreases as the energy of the photons is decreased from the bulk absorption threshold energy to the surface absorption threshold energy.

15. The tunable halogen particle generator of claim 14, wherein the solid halide sample satisfies the formula $MX_2$ wherein M is a metal and X is a halogen.

16. The particle generator of claim 14 further comprising a collimating means arranged to accept a spatially defined plume of hyperthermal halogen atoms.

17. The particle generator of claim 16, wherein the collimating means comprises an aperture.

18. The particle generator of claim 14 further comprising a velocity selector.

19. A halogen particle generator, comprising;

a polycrystalline solid halide sample;

a photon source arranged to deliver photons to a surface of the sample, the photons having an energy that is less than a bulk absorption threshold energy of the sample and greater than a surface absorption threshold energy of the sample.

20. The halogen particle generator of claim 19, wherein the sample emits hyperthermal halogen atoms when photons are delivered to the surface of the sample, the hyperthermal halogen atoms having a velocity that decreases as the energy of the photons is decreased from the bulk absorption threshold energy to the surface absorption threshold energy.

21. The halogen particle generator of claim 19, wherein the polycrystalline solid halide sample is selected from the group consisting essentially of LiF, NaF, KF, RbF, CsF, LiCl, NaCl, KCl, RbCl, CsCl, LiBr, NaBr, KBr, RbBr, CsBr, LiI, NaI, KI, RbI, CsI, $MgF_2$, $CaF_2$, $SrF_2$, $BaF_2$, $MgCl_2$, $CaCl_2$, $SrCl_2$, $BaCl_2$, $MgBr_2$, $CaBr_2$, $SrBr_2$, $BaBr_2$, $MgI_2$, $CaI_2$, $SrI_2$, $BaI_2$, $FeF_2$, $FeCl_2$, $FeBr_2$, $FeI_2$, $ZnF_2$, $ZnCl_2$, $ZnBr_2$, $ZnI_2$, $NiF_2$, $NiCl_2$, $NiBr_2$, $NiI_2$, $MnF_2$, $MnCl_2$, $MnBr_2$, $MnI_2$, $CoF_2$, $CoCl_2$, $CoBr_2$, $CoI_2$ and mixtures and co-crystals thereof.

22. A method for producing halogen particles, comprising:

exposing a surface of a halide sample to photons having an energy less than a bulk absorption threshold energy of the halide sample and greater than a surface absorption threshold energy of the halide sample to produce halogen particles; and selecting halogen particles emitted from the surface of the halide sample in a directional plume having a particle trajectory distribution around a normal to the surface that is substantially described by a cone of 50 degrees about a normal relative to the surface of the sample.

23. A method for producing a beam of halogen particles having a tunable kinetic energy, comprising:

providing a flux of photons, the photons having an average energy between about 0.2 eV below the energy of a lowest energy absorption peak of a solid halide sample and a surface absorption threshold energy of the halide sample; and directing the flux of photons to a surface of the halide sample to stimulate emission of hyperthermal halogen atoms, the average kinetic energy of the hyperthermal halogen atoms being directly proportional to the average energy of the photons.

24. The method of claim 23, wherein the photon energy is between a bulk absorption threshold of the solid halide sample and the surface absorption threshold energy of the solid halide sample.

25. The method of claim 23, wherein the halide sample satisfies the formula $MX_2$ wherein M is a metal and X is a halogen.

26. The method of claim 23, wherein the halide sample comprises KBr and the photons have an average energy between about 5.5 eV and about 6.5 eV.

27. The method of claim 25, wherein the halide sample comprises KI and the photons have an average energy between about 5.1 eV and about 5.9 eV.

28. A method for stimulating emission of excited state halogen atoms from a solid halide sample, comprising:

exposing a halide sample to a first flux of photons, the first photons having an energy lower than a surface absorption threshold of the halide sample, the first flux having an intensity sufficient to stimulate a multiphoton absorption process; and exposing the halide sample to a second flux of photons, the second photons having an energy lower than the surface absorption threshold of the halide sample and corresponding to an energy absorbed by transient species produced in the halide sample by the first flux of photons.

29. The method of claim 28, wherein exposing the halide sample to the first photon flux and exposing the halide sample to the second photon flux are performed within 100 microseconds of each other.

30. A method, comprising:

exposing a surface of a solid halide sample to photons having an energy between a bulk absorption threshold energy of the sample and a surface absorption threshold energy of the sample to stimulate emission of hyperthermal particles; and positioning a target along a path substantially normal relative to the surface of the solid halide sample to receive the hyperthermal halogen particles emitted from the solid halide sample.

31. The method of claim 30, wherein the hyperthermal halogen particles are collimated.

32. The method of claim 30, wherein the energy of the photons is tuned between the surface absorption threshold and the bulk absorption threshold of the halide sample.

33. The method of claim 30, wherein the hyperthermal halogen particles are passed through a velocity selector.

34. The method of claim 30, wherein the target comprises a semiconductor.

35. The method of claim 30, wherein the target is a semiconductor wafer having a surface to be etched.

36. The method of claim 30, wherein the target is oriented to promote etching along a crystal axis exposed on the surface of the wafer.

37. The particle generator of claim 1 further comprising a means to rotate or translate the sample.

38. The particle generator of claim 12 further comprising a rotator to translate the sample.

* * * * *

UNITED STATES PATENT AND TRADEMARK OFFICE

CERTIFICATE OF CORRECTION

PATENT NO. : 6,911,649 B2
DATED : June 28, 2005
INVENTOR(S) : Wayne P. Hess et al.

It is certified that error appears in the above-identified patent and that said Letters Patent is hereby corrected as shown below:

Column 8,
Line 45, "excited" should read -- excite --.

Signed and Sealed this

Eighteenth Day of April, 2006

JON W. DUDAS
*Director of the United States Patent and Trademark Office*